US007182722B2

(12) United States Patent
Kim

(10) Patent No.: US 7,182,722 B2
(45) Date of Patent: Feb. 27, 2007

(54) FILM ROLL HOLDER FOR LAMINATORS

(75) Inventor: Yang-Pioung Kim, Seoul (KR)

(73) Assignee: GMP Co., Ltd., Paju-si (KR)

( * ) Notice: Subject to any disclaimer, the term of this patent is extended or adjusted under 35 U.S.C. 154(b) by 425 days.

(21) Appl. No.: 10/796,407

(22) Filed: Mar. 9, 2004

(65) Prior Publication Data

US 2004/0214699 A1 Oct. 28, 2004

(30) Foreign Application Priority Data

Apr. 25, 2003 (KR) ..... 10-2003-0026353

(51) Int. Cl.
*B25F 5/02* (2006.01)

(52) U.S. Cl. ..... 492/47; 492/45; 492/36

(58) Field of Classification Search ..... 492/45, 492/47, 36, 17; 242/571, 573.9, 571.6, 579
See application file for complete search history.

(56) References Cited

U.S. PATENT DOCUMENTS 3,001,736 A * 9/1961 Schultz et al. ..... 242/571.6
3,387,799 A * 6/1968 Wilson ..... 242/571.6
3,552,673 A * 1/1971 Evers ..... 242/571.3
4,066,270 A * 1/1978 Elkin ..... 279/2.13
5,904,315 A * 5/1999 McInerney ..... 242/571

* cited by examiner

*Primary Examiner*—Marc Jimenez
(74) *Attorney, Agent, or Firm*—Egbert Law Offices

(57) ABSTRACT

A film roll holder for laminators by which a hollow paper tube wound with a film thereon is held around a rolling shaft of a laminator while the film wound around the hollow paper tube is transferred to a heating roller, thus preventing air pockets from being generated between the film and the surface of the objective material and preventing wrinkles from being formed on the film. The film roll holder includes a cylindrical body having a shaft hole; an annular groove; and a plurality of elongated grooves. There is a support blade unit inserted into each of the elongated grooves of the cylindrical body. The support blade unit has a plurality of support blades and a fitting notch. The film roll holder further includes a rubber ring fitted over each of the annular grooves, and a cover mounted to each of both ends of the cylindrical body by a plurality of mounting bolts.

1 Claim, 4 Drawing Sheets

FILM ROLL HOLDER FOR LAMINATORS

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to film roll holders for laminators, and more particularly to a film roll holder for laminators by which a hollow paper tube wound with a film thereon is held around a rolling shaft of a laminator to tense the film while the film wound around the hollow paper tube is transferred to a heating roller unit for thermal coating of the film on a surface of an objective material, thus preventing air pockets from being generated between the film and the surface of the objective material and preventing wrinkles from being formed on the film-coated products.

BACKGROUND OF THE INVENTION

Generally, conventional laminators include a heating roller unit having two heating rollers, and two rolling shafts which are respectively provided at upper and lower portions of the laminator and each supports a paper tube wound with a film thereon. The films of the two paper tubes along with an objective material are supplied between the two heating rollers, so that the films are coated on upper and lower surfaces of the objective material. However, in the conventional laminator, because the films are supplied between the two heating rollers by only the rotating force of the two heating rollers, both the paper tubes wound with the films are not evenly rotated. Thus, the films of the two paper tubes are loosely supplied between the heating rollers while being coated on the upper and lower surfaces of the objective material. Therefore, the conventional laminator is problematic in that air pockets may be undesirably generated between the film and the surface of the objective material, thus increasing the number of defective products. The conventional laminator further cause wrinkles formed on the surface of the film-coated products.

To solve the problems experienced in the above-mentioned conventional laminator, a film roll holder 10 for laminators was proposed, as shown in FIG. 1. As shown in the drawing, two film roll holders 10 are provided at predetermined portions of each of upper and lower rolling shafts 11 which are respectively provided above and below a heating roller unit 12 in the laminator. A film roll is supported around each of the two rolling shafts 11 by the film roll holders 10. Each of the film roll holders 10 includes a shaft hole 1 which is axially holed in the film roll holder 10 to allow the film roll holder 10 to be fitted over the rolling shaft 11 through the shaft hole 1. The film roll holder 10 in the above state is mounted on the rolling shaft 11 by a first locking bolt 2. The film roll holder 10 further includes a support blade unit 4 which is mounted on an upper portion of the film roll holder 10 by a plurality of second locking bolts 3 to support a paper tube of the film roll on the rolling shaft 11 while an outer edge of the support blade unit 4 is in contact with an inner surface of the paper tube of the film roll.

However, the conventional film roll holder 10 is problematic as follows: The conventional film roll holder 10 is possible to support the film roll when the film roll is rotated in only one direction. Therefore, when the film roll is rotated in a reverse direction, the film roll holder 10 cannot execute a role as the holder for supporting the film roll. Furthermore, the film generally has at one surface thereof a release layer. Thus, when a user mistakenly sets the film roll to a rolling shaft in a reverse direction, the laminator with the conventional film roll holder 10 may not coat the film on the surface of the objective material, thus causing defective products. Furthermore, when the film roll is set around each of the rolling shafts, the film roll must be precisely positioned to be parallel with the rolling shaft. Therefore, the laminator with the conventional film roll holder 10 forces the user to pick up the heavy film rolls to a height of the two rolling shafts for the film roll setting process.

BRIEF SUMMARY OF THE INVENTION

Accordingly, the present invention has been made keeping in mind the above problems occurring in the prior art, and an object of the present invention is to provide a film roll holder for laminators which is possible to set a paper tube of a film roll on a rolling shaft of a laminator regardless of a rotating direction of the film roll, thus reducing material loss generated by a defective setting of the film roll, and which has an improved setting structure to allow a user to easily set the film roll on the rolling shaft.

In order to accomplish the above object, the present invention provides a film roll holder for laminators, including, a cylindrical body having a shaft hole axially holed in the cylindrical body; an annular groove circumferentially provided on each of both ends of the cylindrical body; and a plurality of elongated grooves axially provided around an outer surface of the cylindrical body to be spaced apart from each other at predetermined intervals, and a support blade unit inserted into each of the elongated grooves of the cylindrical body. The support blade unit has a plurality of support blades provided along an outside edge of the support blade unit; and a fitting notch provided at each of both ends of the support blade unit. The film roll holder further includes a rubber ring fitted over each of the annular grooves provided on both ends of the cylindrical body while being placed in the fitting notches of the support blade units, thus holding the support blade units respectively inserted into the elongated grooves of the cylindrical body, and a cover mounted to each of both ends of the cylindrical body by a plurality of mounting bolts, with a tapered surface provided on an outer end of the cover.

BRIEF DESCRIPTION OF THE SEVERAL VIEWS OF THE DRAWINGS

The above and other objects, features and other advantages of the present invention will be more clearly understood from the following detailed description taken in conjunction with the accompanying drawings.

DETAILED DESCRIPTION OF THE INVENTION

Figure 1:
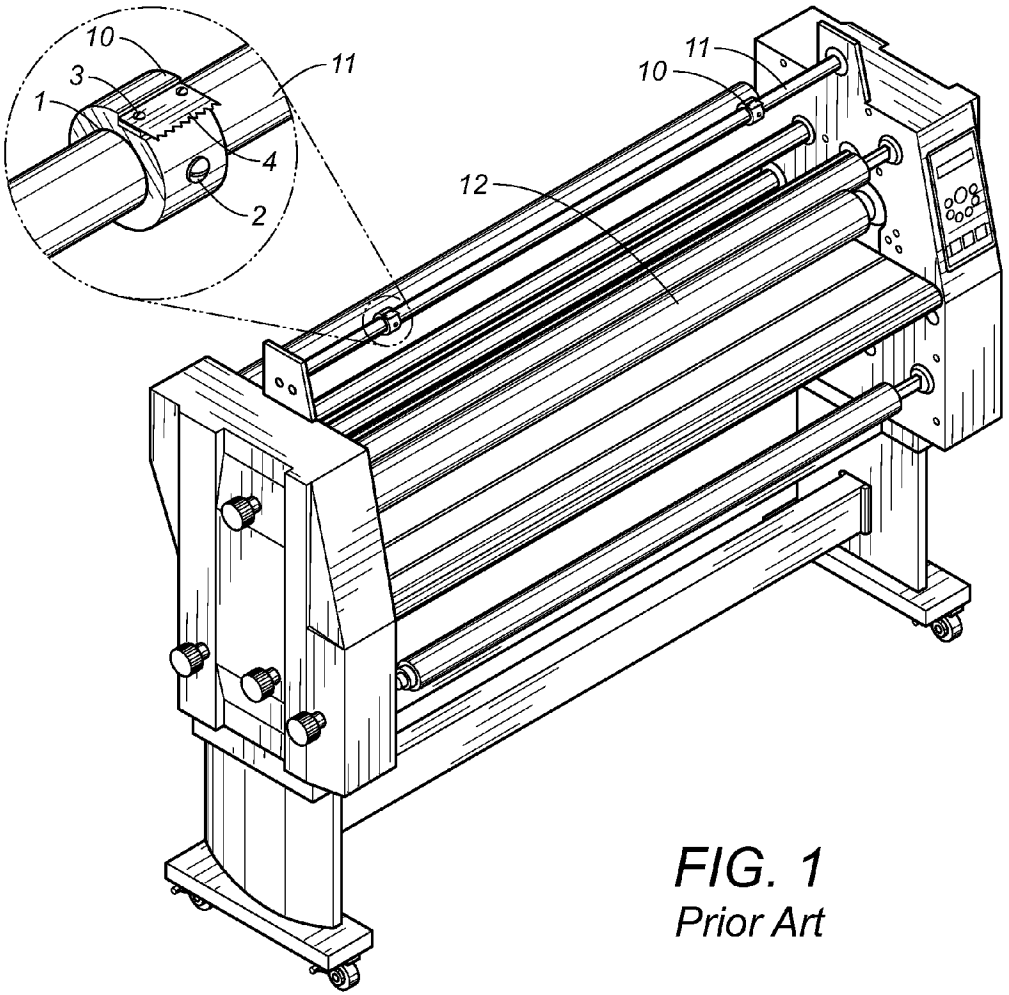
FIG. 1 Prior Art
FIG. 1 is a perspective view of a laminator having a conventional film roll holder.

Hereinafter, embodiments of the present invention will be described in detail with reference to the attached drawings.

Reference now should be made to the drawings, in which the same reference numerals are used throughout the different drawings to designate the same or similar components.

Figure 2:
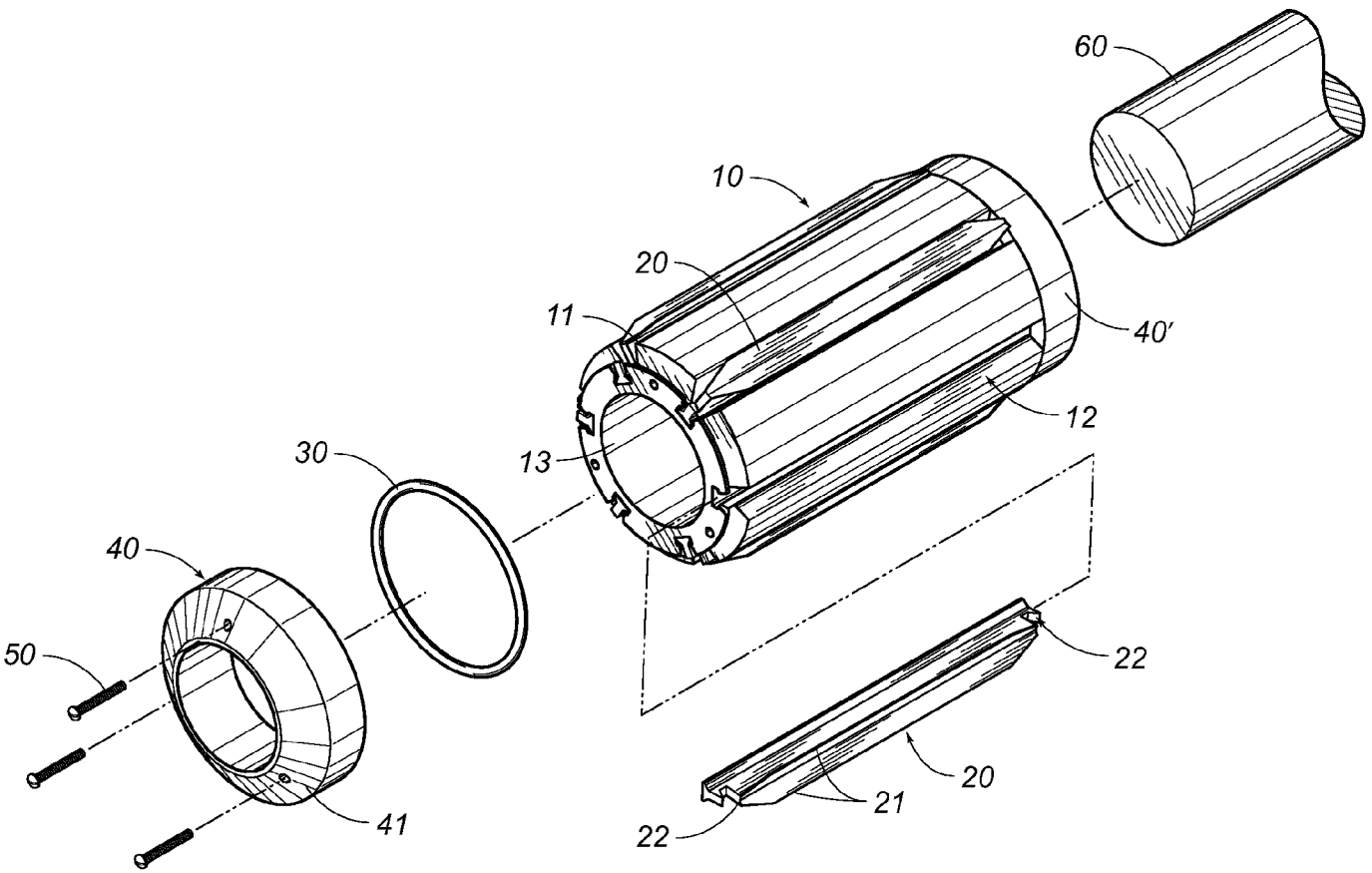
FIG. 2 is an exploded perspective view of a film roll holder for laminators, according to an embodiment of the present invention.
Figure 3:
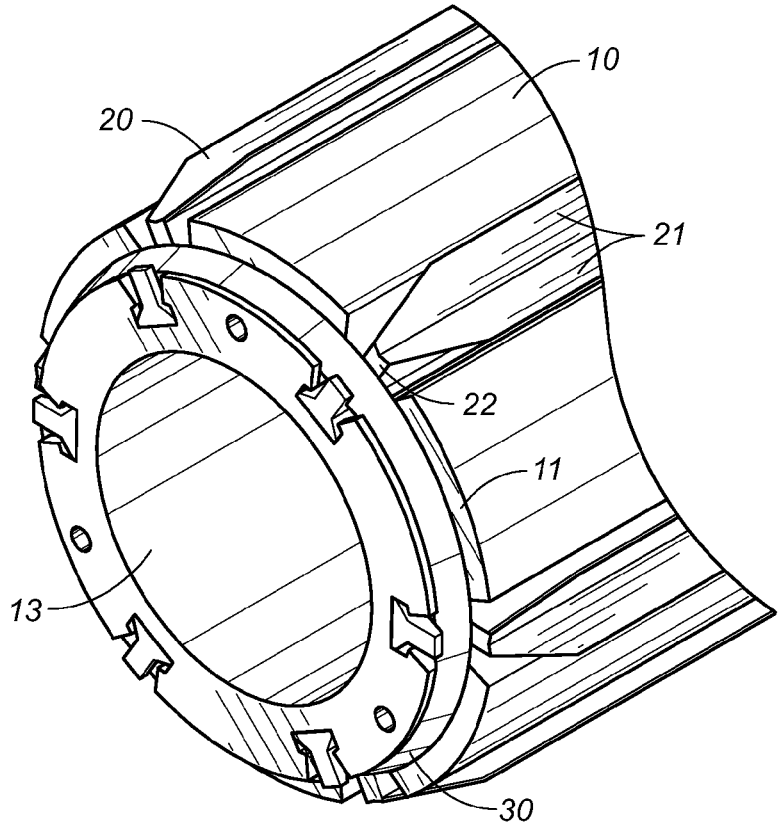
FIG. 3 is a partially enlarged perspective view of the film roll holder of FIG. 2.
Figure 4:
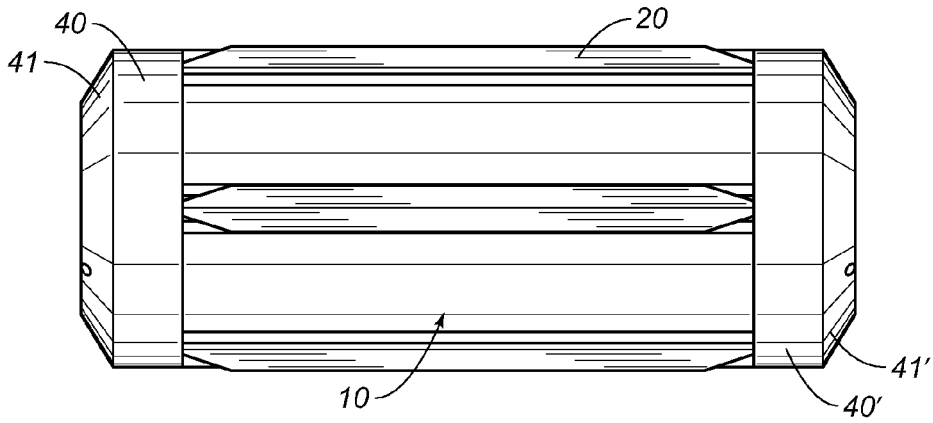
FIG. 4 is a front elevation view of the film roll holder of FIG. 2.
Figure 5:
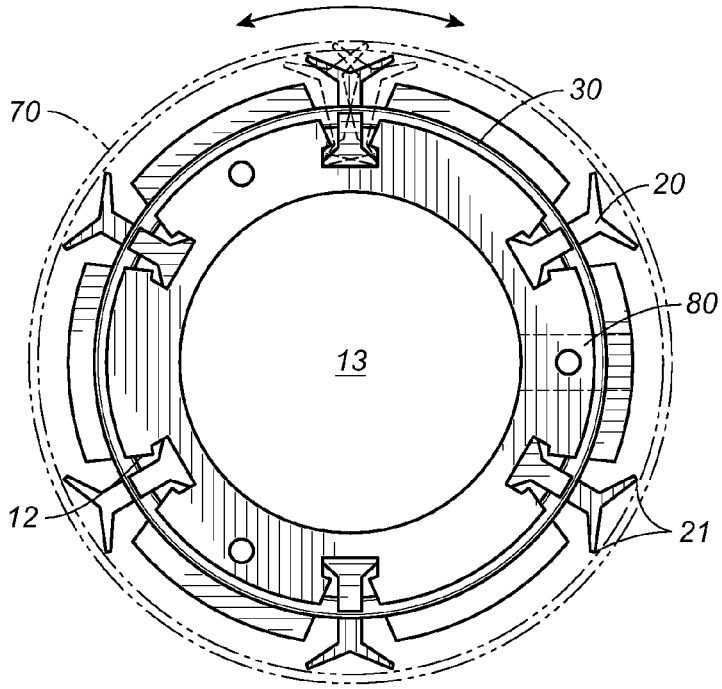
FIG. 5 is a side elevation view showing the operation of the film roll holder of FIG. 2.

FIG. 2 is an exploded perspective view of a film roll holder for laminators, according to an embodiment of the present invention. FIG. 3 is a partially enlarged perspective view of the film roll holder of FIG. 2. FIG. 4 is a front view of the film roll holder of FIG. 2. FIG. 5 is a side view showing the operation of the film roll holder of FIG. 2.

As shown in FIGS. 2 through 4, the film roll holder according to the embodiment of the present invention includes a cylindrical body 10. The cylindrical body 10 has a shaft hole 13 which is axially holed in the cylindrical body 10, an annular groove 11 which is circumferentially provided on each of both ends of the cylindrical body 10, and a plurality of elongated grooves 12 which are axially provided around an outer surface of the cylindrical body 10 to be spaced apart from each other at predetermined intervals.

The film roll holder further includes a support blade unit 20 which is inserted into each of the elongated grooves 12 of the cylindrical body 10. The support blade unit 20 has a plurality of support blades 21 which are provided along an outside edge of the support blade unit 20, and a fitting notch 22 which is provided at each of both ends of the support blade unit 20.

The film roll holder further includes a rubber ring 30 which is fitted over each of the annular grooves 11 provided on both ends of the cylindrical body 10. The rubber ring 30 is also placed in the fitting notches 22 of the support blade units 20, thus holding the support blade units 20 respectively inserted into the elongated grooves 12 of the cylindrical body 10. The film roll holder further includes two covers 40 and 40' which are respectively mounted to both ends of the cylindrical body 10 by a plurality of mounting bolts 50, with tapered surfaces 41 and 41' each provided on an outer end of each of the two covers 40 and 40'.

In the drawings, the reference numeral 80 denotes a locking bolt hole to secure the film roll holder around a rolling shaft 60 of a laminator having a plurality of film roll holders of the present invention.

The operation and effect of the film roll holder of the present invention will be described herein below, with reference to FIG. 5.

A diameter of the paper tube 70 wound with the film typically ranges from 1 inch to 3 inches.

The two covers 40 and 41 of the film roll holder respectively have the tapered surfaces 41 and 41' at the outer ends thereof. Therefore, when the paper tube 70 of the film roll is set around the film roll holders which are supported around the rolling shaft 60 of the laminator, the paper tube 70 is precisely set around the film roll holders while an end of the paper tube 70 is guided by one of the tapered surfaces 41 and 41' of the two covers 40 and 41 of each of the film roll holders, even though the paper tube 70 is not positioned in parallel with the rolling shaft 60 of the laminator. Thereafter, the film of the paper tube 70 is transferred to the heating roller unit 12 while the paper tube 70 is rotated in a direction in the laminator. At this time, the plurality of support blade units 20 of each of the film roll holders, which hold the paper tube 70 on the rolling shaft 60, are respectively slightly tilted in the same direction as the rotating direction of the paper tube 70 around the lower portions of the support blade units 20, so that one of the support blades 21 of each of the support blade units 20 bites the inner surface of the paper tube 70. Due to the abovementioned motions of the support blade units 20 of each of the film roll holders, the paper tube 70 of the film roll is firmly supported around the rolling shaft 60 of the laminator by the film roll holders.

In further detailed, an outside diameter of the film roll holder, when the plurality of support blade units 20 are slightly tilted around the lower portions thereof as described above, is increased by an amount of an increase in a radius of rotation of each of the support blade units 20 than the original outside diameter of the film roll holder when any paper tube 70 is not set around the film roll holder. Therefore, the paper tube 70 is firmly supported by the film roll holder around the rolling shaft 60 of the laminator while the paper tube 70 is rotated.

When the paper tube 70 is desired to be removed from the rolling shaft 60, a user rotates the paper tube 70 in a reverse direction. Thus, the plurality of support blade units 20 of each of the film roll holders are slightly tilted around the lower portions thereof in the reverse direction to restore original positions thereof by a restoring force of the rubber ring 30 which is fitted over each of the annular grooves 11 of the cylindrical body 10 while being placed in the fitting notches 22 of the support blade units 20. Therefore, the outside diameter of each of the film roll holders is returned to the original outside diameter of the film roll holders without holding any paper tube 70 thereon, thus allowing the user to easily remove the paper tube 70 from the film roll holders.

As described above, the present invention provides a film roll holder for laminators which firmly supports a paper tube of a film roll by motions of support blade units, different from a conventional film roll holder, and in which the support blade units are perpendicularly placed on the film roll holder, as desired.

Furthermore, the film roll holder of the present invention is used in a laminator regardless of a width and a kind of the film, and allows a user to easily change the film roll with a new one during a laminating process. Furthermore, the film roll holder of the present invention reduces the production costs thereof.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

I claim:

1. A film roll holder for laminators, comprising:

a cylindrical body comprising:

a shaft hole axially holed therein;

an annular groove circumferentially provided on each of both ends thereof; and a plurality of elongated grooves axially provided around an outer surface of the cylindrical body to be spaced apart from each other at predetermined intervals;

a support blade unit inserted into each of the elongated grooves of the cylindrical body, the support blade unit comprising:

a plurality of support blades provided along an outside edge thereof; and a fitting notch provided at each of both ends thereof;

a rubber ring fitted over each of the annular grooves provided on both ends of the cylindrical body while being placed in the fitting notches of the support blade units, the support blade units being held and respectively inserted into the elongated grooves of the cylindrical body; and a cover mounted to each of both ends of the cylindrical body by a plurality of mounting bolts, with a tapered surface provided on an outer end of the cover.

* * * * *